United States Patent [19]

Lee

[11] Patent Number: 5,006,089

[45] Date of Patent: Apr. 9, 1991

[54] LIFE-LIKE TOY ANIMAL

[75] Inventor: James S. W. Lee, Long Island, N.Y.

[73] Assignee: C. J. Associates, Ltd., Monrovia, Liberia

[21] Appl. No.: 411,406

[22] Filed: Sep. 22, 1989

[51] Int. Cl.[5] ..... A63H 3/02

[52] U.S. Cl. ..... 446/267; 446/370; 446/385; 446/901

[58] Field of Search ..... 446/267, 74, 73, 369, 446/268, 385; 273/DIG. 29, 58 H

[56] References Cited

U.S. PATENT DOCUMENTS

| | | | |
|---|---|---|---|
| 3,601,923 | 8/1971 | Rosenberg | 446/267 |
| 4,204,110 | 5/1980 | Smit et al. | 446/72 X |
| 4,242,830 | 1/1981 | Hauser | 446/267 X |
| 4,575,351 | 3/1986 | Gonzalez | 446/369 X |
| 4,648,880 | 3/1987 | Brauman | 623/8 |

*Primary Examiner*—Mickey Yu

*Attorney, Agent, or Firm*—Laff, Whitesel, Conte & Saret

[57] ABSTRACT

A stuffed animal has a closed fluid containing liner filled with a viscous silicon or silicon/water material. The weight of the silicon/water material gives the animal a life-like weight. The liner is covered by a fur-like plush. The viscous material may be a material used to make a prosthesis of a human organ. If desired a material such as a plastic simulation of a skeleton may be added to give a feel of bone. The "skeleton" may have a plastic memory for causing the animal to retract its leg, paw, or the like after it has been stretched. Small patches of hook and loop fasteners may be used to secure the animal in a desired posture.

12 Claims, 2 Drawing Sheets

LIFE-LIKE TOY ANIMAL

This invention relates to toys and more particularly to life-like, cuddly, and squeezable toys especially—although not exclusively—stuffed animals for all ages including infants, young women, and senior citizens.

In the following specification, a reference is made to a puppy, by way of example. However, it should be understood that the same principles apply to any of many animals and objects.

Likewise the following specification makes reference to the invention as a toy or decoration for children and young women; however, the inventive device may be of interest to all ages, including senior citizens. The invention focuses on today's problems relating to raising a live animal, such as a dog, as a pet. It is a costly luxury which is made worse by living in an apartment, nursing home, condominium, or the like. Yet, the desire and tradition of keeping a pet, such as a dog, remains. The life-like features of the inventive animal may satisfy those desires and may enable people to fantasize a friendship with a pet.

Infants and small children usually form an attachment to some kind of a security object which they can clutch, especially when they are going to sleep. Examples of such devices are blankets, stuffed animals, and the like. Also, in general, people of all ages often want similar devices for a variety of reasons, such as a gift to a loved one, a cute display, or the like.

For example, a young woman in a college dormitory or an office might want to place a stuffed animal at a location which makes an artistic display on a bed or at a desk, much as a picture, plant, wall hanging, or the like might form a display. Regardless of who might use a stuffed animal or why they might use it, the more realistic the animal, the better it is liked.

Many years ago, cotton or similar materials were used as stuffing to give a softer, more realistic feel to the animals. Among other things, these materials gave the animal a light weight which made it seem more like a pillow than like an animal. Since then, greater realism has been achieved by such things as hot water bottles to give warmth and softness to the stuffed animal. One patent (U.S. Pat. No. 4,169,336) provides an elastic body which is filled with a viscous fluid such as sugar solutions, molasses, corn syrup, sucrose, glucose, pine pitch, rosin, and asphaltum.

It is thought that still greater realism may be obtained by providing stuffed animals made with a more modern material. Also, a more life like simulation may be obtained by simulating bones and the actual weight of an animal, and by giving the animal an improved expression, posture, and the like.

Accordingly, an object of this invention is to provide new, improved, and more life-like stuffed and squeezable animals. Here, an object is to provide a stuffed animal which has a more life-like weight and feel of flesh and bone. Yet another object of the invention is to provide a stuffed animal with a posture which may be made to more nearly simulate a posture of a real animal.

Another object of the invention is to provide a stuffed animal which a child may care for, as if it were a live animal.

Still another object of the invention is to provide stuffed animals which appeal to all ages including young women, senior citizens and other individuals who might, for example, wish to have a stuffed animal that might hang from or cling to a desk, work station, peep over the top of a computer terminal, or the like.

In keeping with an aspect of the invention, these and other objects are provided by an animal-like figure having a life-like touch, feel, and weight. A plush, fur like covering has an interior envelope or shell of thin PVC or the like. The shell is filled with a silicon/water or viscous liquid and may also include a molded plastic shell or skeleton, which together give a feel of flesh and bone. A self-adhesive or fastening material is attached to the paws so that the stuffed animal may stand or hang in a manner characteristic of a live animal which is simulated by the stuffed animal. In particular, an accurate simulation of the "weight" of a live animal is an outstanding feature. The fluid contents of the filling material tends to set a rhythm of motion, so that the animal seems to have a more life-like, naturally occurring, mechanical feature which tends to dislodge the contact between paws and a surface on an object.

The structure of the invention is shown the attached drawings, in which:

FIG. 7 illustrates how the puppy may become an object to be cared for.

Figure 1:
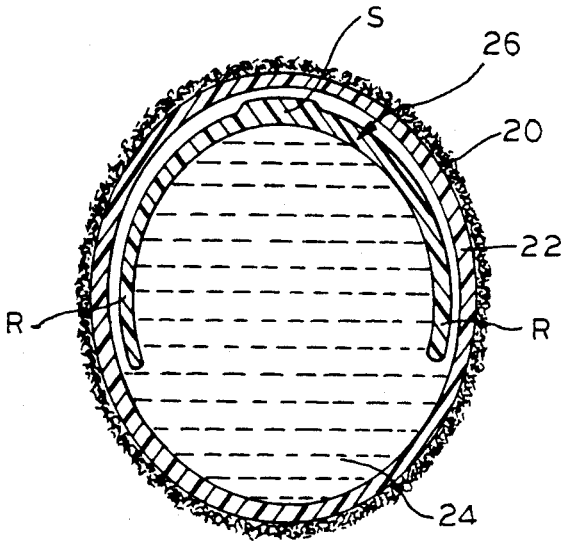
FIG. 1 is a stylized showing of a cross-section of an inventive stuffed animal body in the general region of the rib cage.

In FIG. 1, a cross-section of the stuffed animal is taken in an area where the spine and rib cage of the animal might be located. The outside surface of the animal is covered by a plush cover 20 which has the look and feel of fur. Inside the plush cover 20 is a thin, highly flexible, and closed interior plastic envelope or shell 22 which may be made of any suitable material such as PVC, for containing a viscous liquid 24.

An optional member is a plastic shell or "skeleton" 26, which gives the feel of bones that would be found in the animal. In this particular showing of FIG. 1 the skeleton 26 has the feel of a spine S and ribs R. The skeleton may also have articulated joints somewhat similar to joints in scale model skeletons which are sold commercially. However, since the skeleton will not be seen, it need not have life like detail beyond the "feel" of the "skeleton" which comes through the plush covering. Thus, the joint may simply be a living hinge with knobs on either side so that it feels like a knee joint, for example.

Preferably, the viscous material 24 is a silicon or silicon/water material such as that used to make a prosthesis, such as replacement breasts for mastectomy patients, for example. By a proper selection of the materials for the plush 20, the plastic material 22, and the optional skeleton 26, the body can be given a weight and feel which is similar to the weight and feel of flesh and bones of a small animal.

Figure 3:
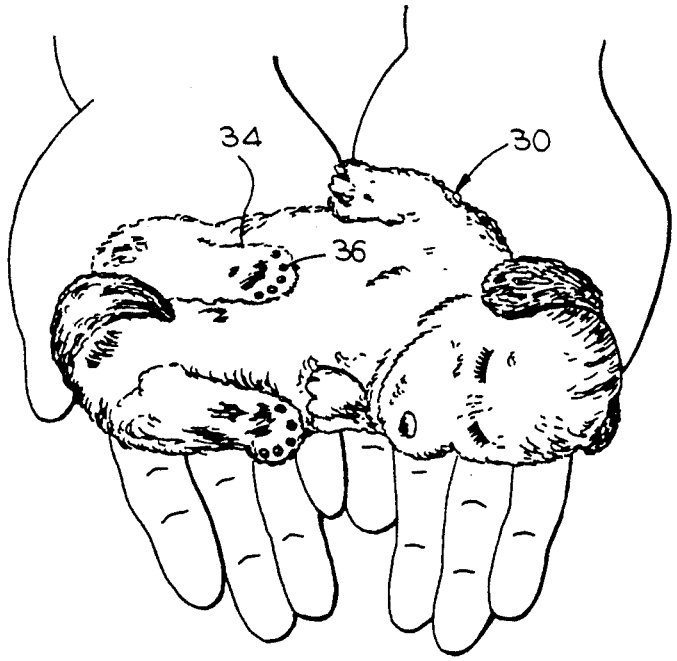
FIG. 3 illustrates how a "new born puppy"—for example—might be handled.

For example, in FIG. 3, a puppy 30 has the general size and shape of a new born puppy. The legs and tail may be articulated to enable them to assume different positions. For example, with an articulated hip and knee joint, the leg may be stretched. With a plastic memory in the articulated joint, the leg may return to a preferred position after it is stretched or moved to another position and then released. This almost makes the animal seem as if it is reacting to the handling by a child.

Figure 2:
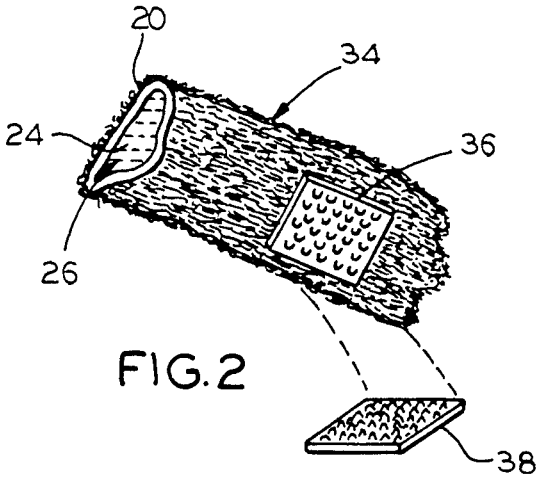
FIG. 2 is a perspective view of a fastener element on a paw of a stuffed animal and on an underlying surface.
Figure 4:
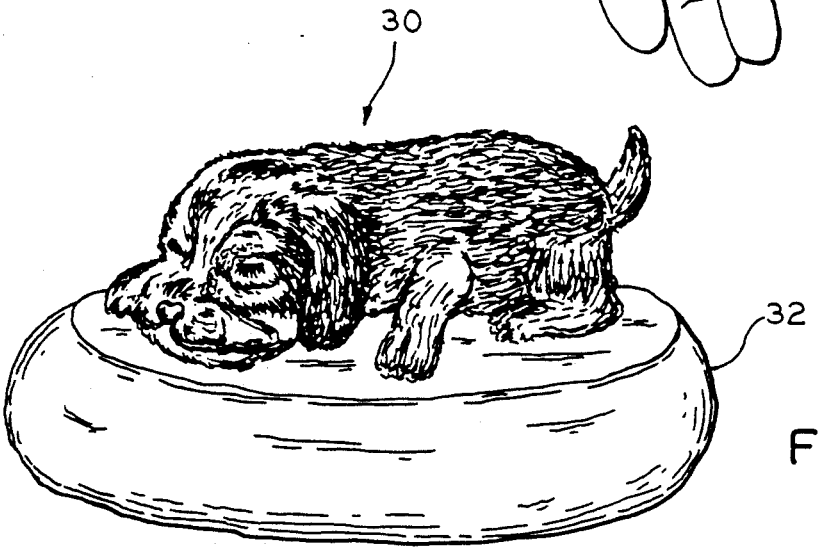
FIG. 4 shows the puppy in combination with another structures, here a cushion.

In FIG. 4, a puppy, which may be substantially the same as the puppy of FIG. 2, is shown sleeping on a cushion 32. The paws of the puppy and the surface of the cushion may have complimentary fasteners 36, 38 (FIG. 2) attached thereto. For example, hook and loop fasteners, sold under the trademark "Velcro", may be used. Of course other kinds of adhesives may also be used. One side 36 of the fastener may be a small patch on the paw of the animal. The other side 38 of the fastener may have a self-adhesive cement covered by a release paper which may be peeled off so that the fastener may be stuck onto almost any proper surface. In a deluxe edition, the fasteners on the paws may be made in the shape and form of the pads and toes 36 (FIG. 3) of the puppy. In a less expensive toy, the paw patches may be simple patches of fastener materials, such as discs or squares. Thus, the paws may be moved and fastened when placed on the cushion. They would return to the sleeping position of FIG. 2 when they are removed from the cushion if a skeleton with a memory is provided. If an adhesive is used, instead of hook and loop fasteners, the animal would cling for a while and then responsive to the weight pulling on the adhesive, the animal can be made to fall, as it pulls the adhesive surfaces apart. This can be made to somewhat simulate the animal becoming tired and giving up.

Figure 5:
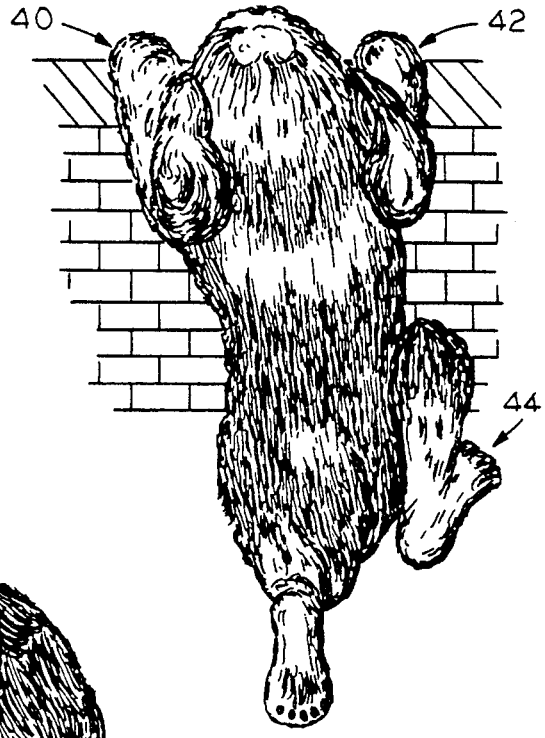
FIG. 5 shows how the posture of the puppy may be made to appear as climbing or begging.

In FIG. 5, patches of fastening material 38 may be placed on any suitable surface to hold the animal. For example, the fasteners may be at 40, 42 and 44 to hold the paws in place, as if the puppy were trying to climb. If there is memory in the plastic shell or skeleton (if provided), the locations of the fastening material 38 will be at locations where the paws are displaced from their normal position.

Figure 6:
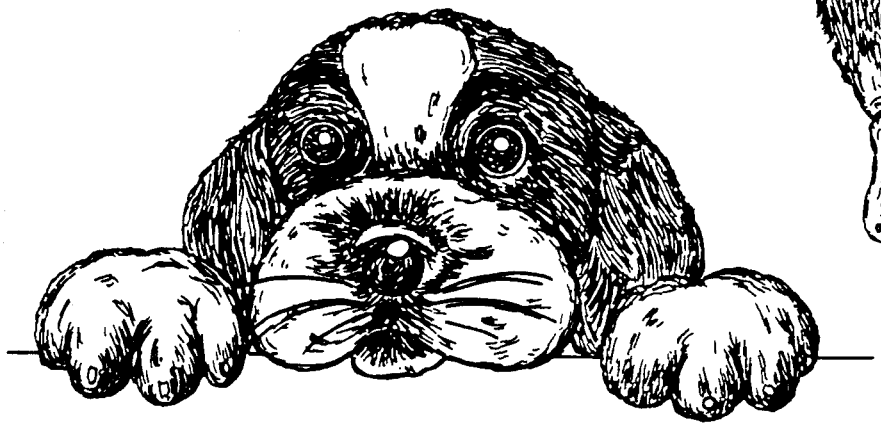
FIG. 6 shows how the puppy may be arranged to give a soulful look as it peeps over the top of another object.

In FIG. 6, the fasteners 38 are placed to hold the paws, and therefore the head, in a position where the puppy is looking soulfully at the on-looker. For example, this puppy may be laying on the top of a computer terminal and peeping over the top at the terminal operator.

The puppy may be given many other postures simply by placing the fastener patches 38 on the cushion (FIG. 3), a basket (FIG. 5), a video display monitor (FIG. 6), a window or the like. The only limitation upon different postures for the stuffed animal is the imagination of the on-looker, who positions the fasteners 38.

Figure 7:
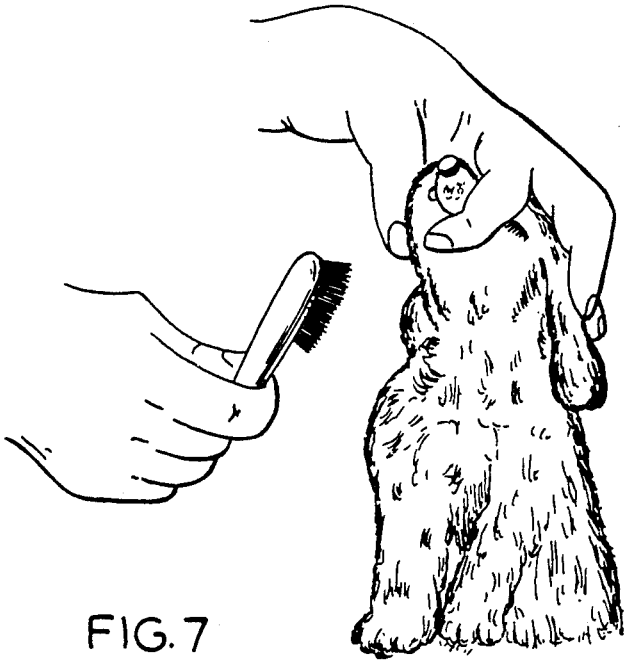

FIG. 7 illustrates one of many relatively simple tasks which a child may undertake in order to care for the "animal". Here the child is brushing the stuffed animal's fur. Quite obviously, there are many other things which a child may do to play like she is caring for the stuffed animal.

An advantage of the invention is that the stuffed animal has a weight and feel of a real flesh and blood animal. The ability to place fasteners in different locations enables the animal to be given a more life-like posture. The stuffed animal is appealing to a relatively small child, an adult or a senior citizen.

Those who are skilled in the art will readily perceive how to modify the invention. Therefore, the appended claims are to be construed to cover all equivalent structures which fall within the true scope and spirit of the invention.

I claim:

1. A stuffed animal having a closed envelope of non-porous material in the shape and form of an animal, a simulated skeleton inside said closed envelope, a plush covering of simulated fur surrounding said envelope of non-porous material, and a viscous material filling said closed envelope, said viscous material and said simulated skeleton having the feel of an animal body.

2. The stuffed animal of claim 1 wherein said viscous material is a silicon based material.

3. The stuffed animal of claim 1 wherein said viscous material is a material used in a prosthesis for a human organ.

4. The stuffed animal of claim 1 wherein said viscous material is a material used in a prosthesis for a human breast.

5. The stuffed animal of claim 3 and fastener means on at least a part of said stuffed animal for securing it to an underlying surface.

6. The stuffed animal of claim 5 wherein said fastener is one side of a hook and loop fastener, the other side of the hook and loop fastener forming means for attaching said stuffed animal to a surface.

7. The stuffed animal of claim 1 wherein said viscous material gives the animal a weight which appears to simulate the weight of a real animal.

8. A stuffed toy comprising a plush fur-like material in the shape and form of an animal, means comprising a closed fluid container lining geometrically conforming to at least a part of said plush fur like material, a plastic skeleton inside said closed fluid container, said skeleton being in approximately the size and shape of the skeleton of said animal, and soft semi-fluid viscous means inside said lining means for giving a life-like weight and feel to said animal.

9. The animal of claim 8 wherein said means inside said lining comprises a silicon material.

10. The animal of claim 9 and means inside said fluid containing means for giving a feel of bone to said animal.

11. A toy in the form of a stuffed animal, said toy comprising thin and flexible means generally in the geometric form of said animal for containing a viscous liquid, a viscous liquid in said containing means, means inside said thin and flexible means for suggesting the bone structure of said animal, and means for covering said form to provide a simulation of the outside surface of said animal.

12. The toy of claim 11 wherein said viscous liquid has a weight which gives the animal a life-like weight.

* * * * *